US012227956B1

(12) United States Patent
Harris

(10) Patent No.: US 12,227,956 B1
(45) Date of Patent: Feb. 18, 2025

(54) POLE STABILIZER

(71) Applicant: Ronald W. Harris, North Little Rock, AR (US)

(72) Inventor: Ronald W. Harris, North Little Rock, AR (US)

( * ) Notice: Subject to any disclaimer, the term of this patent is extended or adjusted under 35 U.S.C. 154(b) by 164 days.

(21) Appl. No.: 17/583,952

(22) Filed: Jan. 25, 2022

Related U.S. Application Data

(60) Provisional application No. 63/218,806, filed on Jul. 6, 2021.

(51) Int. Cl.

| | |
|---|---|
| ***E04H 12/22*** | (2006.01) |
| ***E01F 9/685*** | (2016.01) |
| ***E01F 15/04*** | (2006.01) |
| ***E02D 5/80*** | (2006.01) |
| ***E04H 17/26*** | (2006.01) |

(52) U.S. Cl.
CPC ..... *E04H 12/2269* (2013.01); *E01F 9/685* (2016.02); *E02D 5/80* (2013.01); *E04H 12/2215* (2013.01); *E01F 15/0461* (2013.01); *E04H 12/22* (2013.01); *E04H 17/263* (2013.01)

(58) Field of Classification Search
CPC . E04H 12/2269; E04H 12/2215; E04H 12/22; E04H 17/263; E01F 9/685; E01F 15/0461; E02D 5/80
USPC ..... 52/155–166
See application file for complete search history.

(56) References Cited

U.S. PATENT DOCUMENTS

| | | | | |
|---|---|---|---|---|
| 277,708 | A * | 5/1883 | Gorla | E04H 12/2215 52/154 |
| 278,220 | A | 5/1883 | Carson | |
| 492,520 | A | 2/1893 | Hedges | |
| 925,940 | A | 6/1909 | McClintock | |
| 1,952,789 | A * | 3/1934 | Butts | E04H 12/2215 43/25 |
| 3,896,596 | A * | 7/1975 | Berger | E04H 12/2215 52/153 |
| 4,882,891 | A | 11/1989 | Sero et al. | |
| 5,730,555 | A * | 3/1998 | Stoner | E02D 5/80 405/253 |
| 5,899,030 | A * | 5/1999 | Barefield | E04H 12/2215 403/374.1 |
| 7,484,336 | B2 | 2/2009 | Stone | |
| 10,676,887 | B2 | 6/2020 | Reinert | |
| 2002/0067959 | A1* | 6/2002 | Thornton | E04H 12/2215 405/262 |
| 2014/0373461 | A1* | 12/2014 | Rodriguez | E04H 17/263 52/297 |

FOREIGN PATENT DOCUMENTS

| | | | | |
|---|---|---|---|---|
| KR | 10-1132807 B1 | | 4/2012 | |
| KR | 101334279 B1 | * | 11/2013 | E01F 15/00 |

* cited by examiner

*Primary Examiner* — Omar F Hijaz

(57) ABSTRACT

A pole stabilizer is configured to be set into the ground with the installation of a new pole or retrofitted to existing leaning poles. The stabilizer includes a center body that is fitted to the pole to provide support, and is adapted to be inserted into the ground around the pole. The stabilizer in certain embodiments has wings that extend outwardly to engage the ground around the perimeter of the pole, far enough from the pole to engage ground that was not disturbed when the pole was set. The wings may have serrated lower edges to ease insertion of the stabilizer into the ground.

18 Claims, 6 Drawing Sheets

POLE STABILIZER

CROSS-REFERENCE TO RELATED APPLICATIONS

This application claims the benefit of U.S. provisional patent application No. 63/218,806, filed on Jul. 6, 2021. Such application is incorporated herein by reference in its entirety.

BACKGROUND

Poles are set in the ground for many purposes, including to support outdoor lighting and to support utility lines, such as for electricity service, telephone service, and cable television/Internet service. While at times these poles may be securely set in the ground using concrete or another type of anchoring agent, at other times these poles may be simply set in the ground by the digging of a post hole and then insertion of the pole into the hole. Less work may be performed in setting particularly light poles, such as the decorative hollow fiberglass poles often used for outdoor lighting along streets and sidewalks. These poles may be set in the ground at a quite shallow depth in order to reduce the cost of installation. Poles set at such a shallow depth may begin to lean over time. Even poles that are set more deeply may develop a lean over time, or due to extreme weather events such as tornadoes or hurricanes.

It would be desirable to have a device that would serve to straighten leaning poles, without incurring the cost of re-setting the post. It would further be desirable if such a device were adaptable to be used when setting a new post, such that a pole would never develop a lean at all.

Any references mentioned in this background section are not admitted to be prior art with respect to the present invention.

SUMMARY

The present invention is directed to a pole stabilizer. In various embodiments, the stabilizer may be set into the ground with the installation of a new pole, or may be retrofitted to existing poles, either while the pole is still straight or after the pole has begun to lean. The stabilizer is fitted to the pole to provide support, and is adapted to be inserted into the ground around the pole. The stabilizer in certain embodiments has wings that extend outwardly to engage the ground around the perimeter of the pole, far enough from the pole to engage ground that was not disturbed when the pole was set.

These and other features, objects and advantages of the present invention will become better understood from a consideration of the following detailed description of the preferred embodiments and appended claims in conjunction with the drawings as described following:

DRAWINGS

DESCRIPTION OF THE PREFERRED EMBODIMENT(S)

Figure 1:
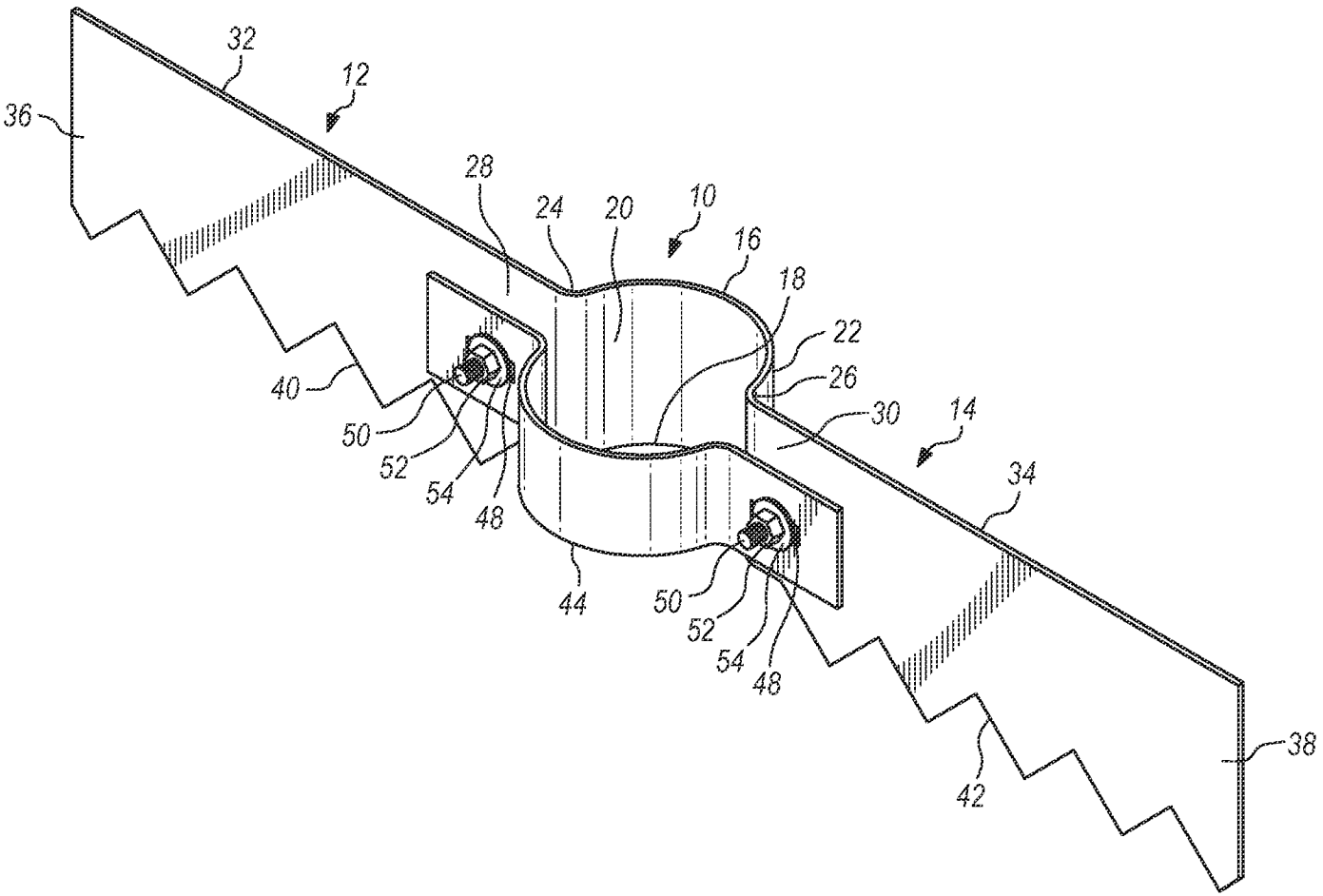
FIG. 1 is a perspective view of an embodiment of the present invention including a bracket.
Figure 2:
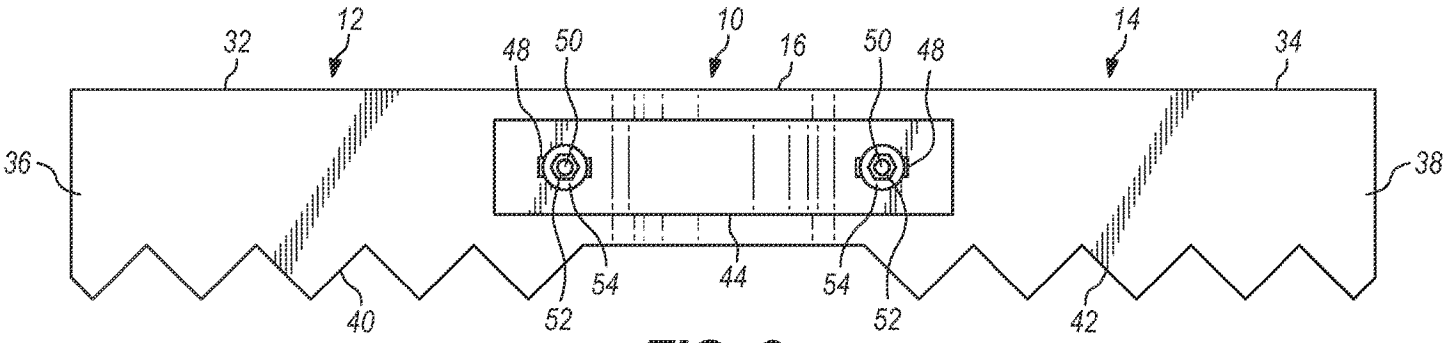
FIG. 2 is a front elevational view of an embodiment of the present invention including a bracket.
Figure 3:
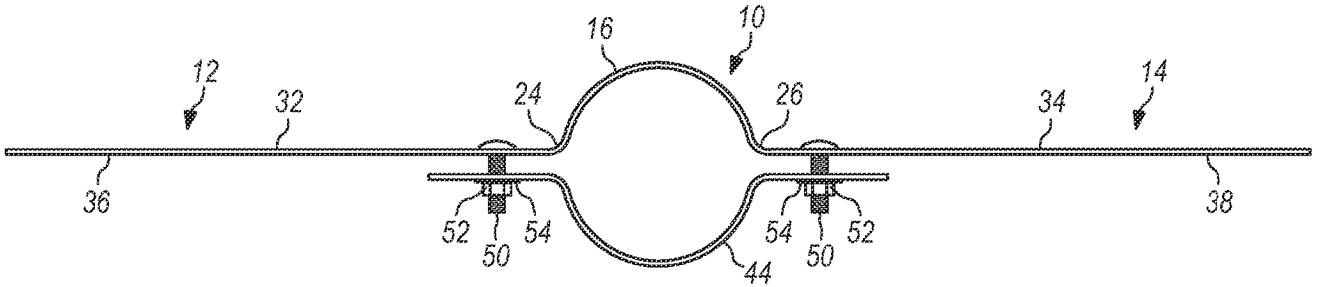
FIG. 3 is a top plan view of an embodiment of the present invention including a bracket.
Figure 4:
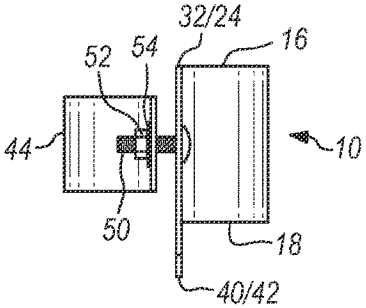
FIG. 4 is an end elevational view of an embodiment of the present invention including a bracket.

Before the present invention is described in further detail, it should be understood that the invention is not limited to the particular embodiments described, and that the terms used in describing the particular embodiments are for the purpose of describing those particular embodiments only, and are not intended to be limiting, since the scope of the present invention will be limited only by the claims.

A pole stabilizer according to an embodiment of the invention is shown in FIGS. 1-4 including a bracket, and in FIGS. 5-8 without the bracket. The stabilizer consists generally of three sections: a center body 10, a first wing 12, and a second wing 14. Each of center body 10, first wing 12, and second wing 14 are generally formed of a flat and thin material. Center body 10 is separated from first wing 12 and second wing 14 by being bent or formed into a semicircular shape. The shape is chosen to conform with the pole to which the stabilizer will be applied. The size of the semicircular area for center body 10 may thus vary in different embodiments. In still other embodiments, center body 10 may be formed into other shapes rather than semicircular in order to conform to the shape of the pole. For example, some poles may be square, hexagonal, or octagonal in cross section. They may also be tapered, in which case the shape of center body 10 may reflect the taper in order to fit snugly to the pole.

First wing 12 and second wing 14 extend radially outward from center body 10. First wing 12 and second wing 14 extend in opposite directions and lie in the same plane along their faces. In alternative embodiments, first wing 12 and second wing 14 may form an angle other than 180 degrees with respect to each other and thus may not lie in the same plane along their faces. In this case, for example, the shape of center body 10 may be less than or more than a semicircle in the case of a pole that is circular in cross-section.

Center body 10 includes a center body top edge 16 and center body bottom edge 18. A thickness at both of center body top edge 16 and center body top edge 18 may be the same, and if the thickness across center body 10 remains the same between center body top edge 16 and center body bottom edge 18, then center body 10 will be entirely flat. Further, the distance from center body top edge 16 to center body bottom edge 18 may be greater than the thickness at either center body top edge 16 or center bottom edge 18. This distance may be of sufficient length that the stabilizer, when placed into the ground snugly with a pole, will provide support for the pole's weight even in high winds. Movement of the pole due to wind may cause a rotational motion at center body 10, such that center body top edge 16 is moved in an opposite direction from center body bottom edge 18 simultaneously. The purpose of first wing 12 and second wing 14 is to engage the ground and resist this movement, as further explained following.

Figure 9:
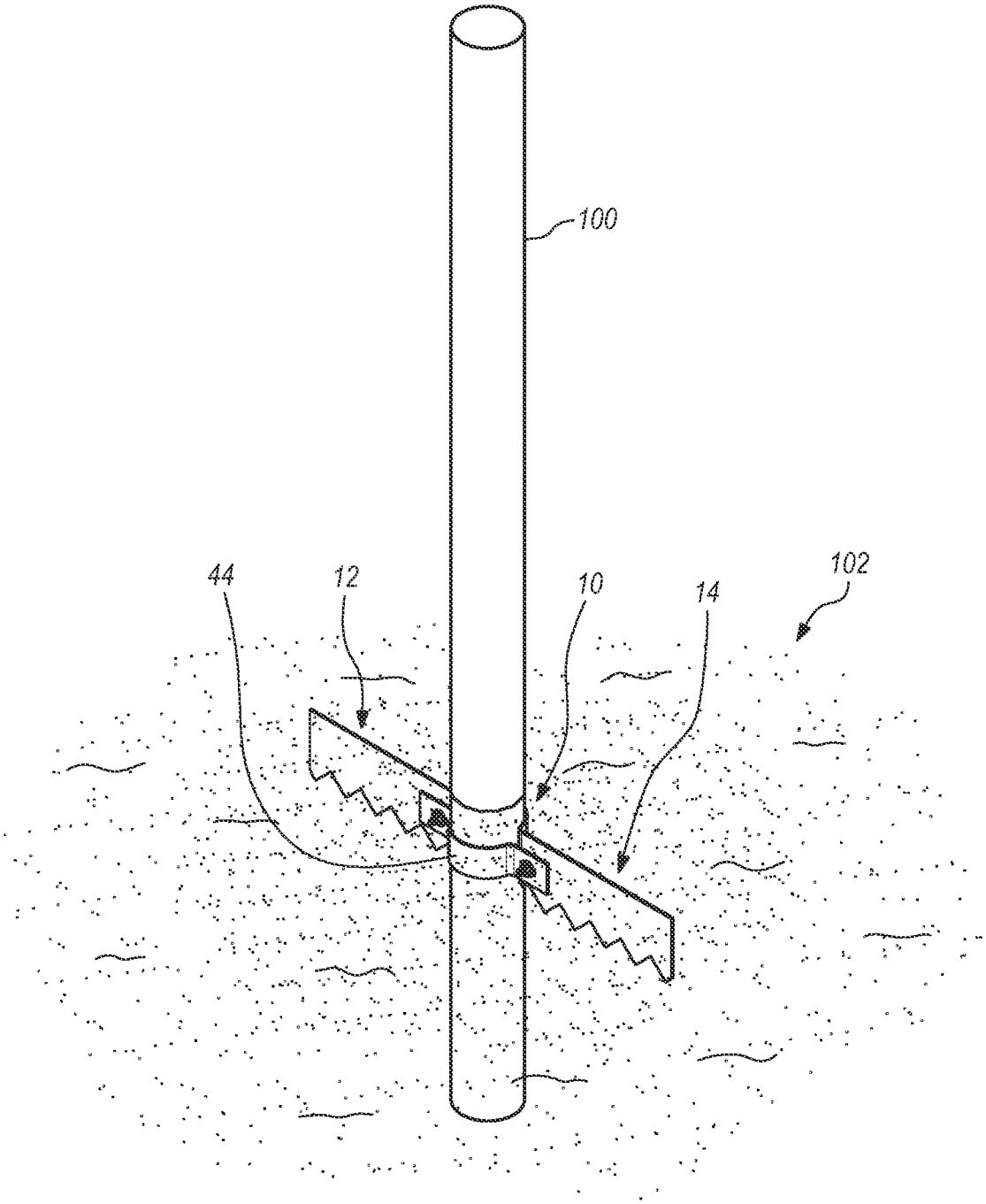
FIG. 9 is a perspective view of an embodiment of the present invention including a bracket with a pole set into the ground.
Figure 10:
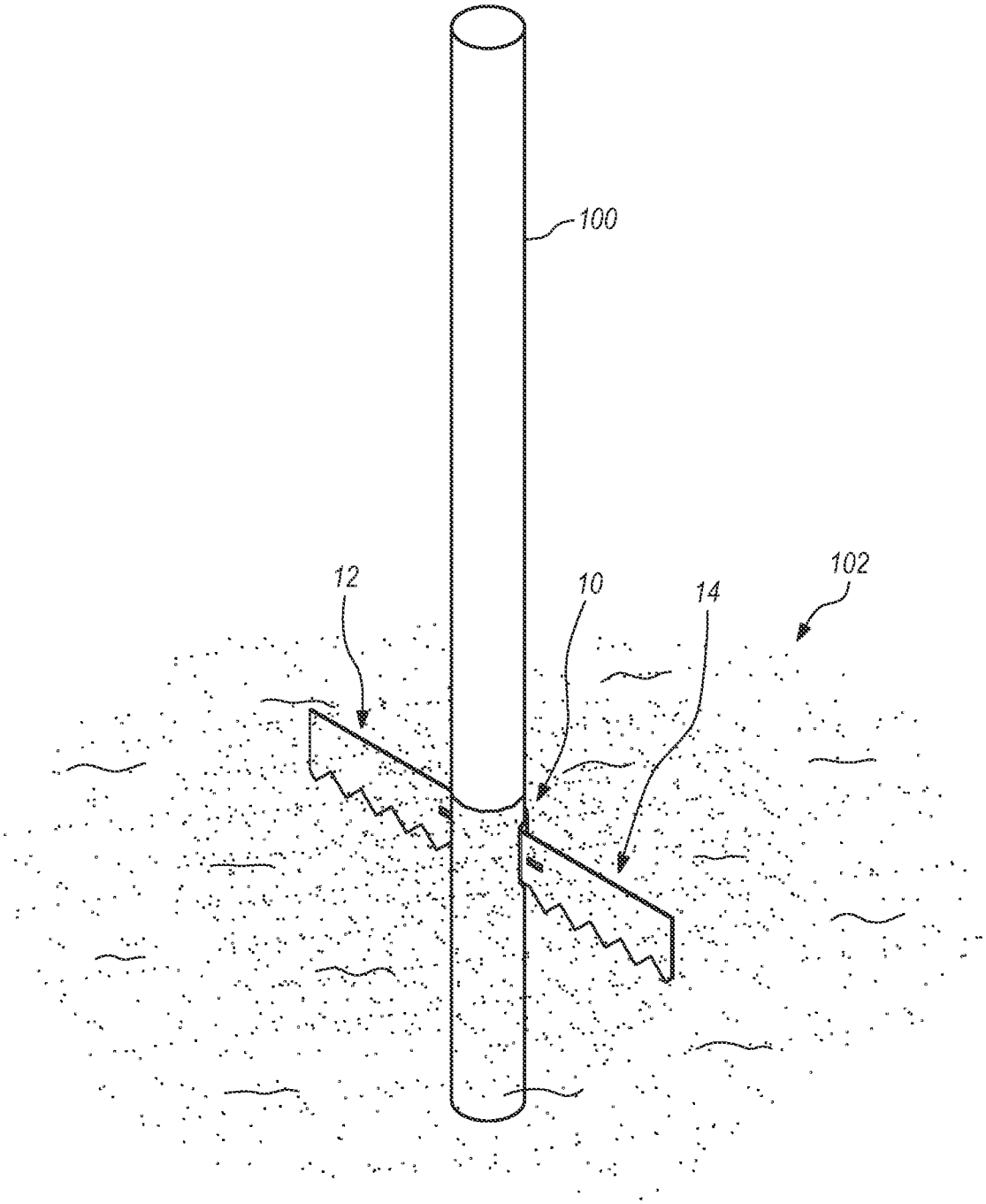
FIG. 10 is a perspective view of an embodiment of the present invention without a bracket with a pole set into the ground.

Center body 10 further comprises a center body inner face 20 and a center body outer face 22. Center body inner face 20 is configured to conform to and engage with the pole when the stabilizer is in use. The length of center body inner face 20 between center body top edge 18 and center body bottom edge 18 is sufficient to provide positive engagement with the pole in order to prevent movement of the pole without a corresponding movement of the stabilizer. Because the stabilizer is locked into the ground by first wing 12 and second wing 14, and with center body inner face 20 positively engaged with the pole, movement of the pole due to wind is prevented. Center body outer face 22 lies on the opposite side of center body 10 from center body inner face 20, and engages with the ground when the stabilizer is in use with respect to a pole fitted into the ground, as shown in FIGS. 9 and 10.

The center body 10 is further defined by first center body side edge 24 and second center body side edge 26. First center body side edge 24 and second center body side edge 26 may, for example, be simply bends in the material that form the division between center body 10 and first wing 12, and center body 10 and second wing 14, respectively. First center body side edge 24 and second center body side edge 26 may be parallel with respect to each other, such as in the case when center body 10 is adapted to fit to a straight-sided, non-tapered pole, or in other cases may not be parallel when, for example, a tapered pole is to be fitted within center body 10. First center body side edge 24 and second center body side edge 26 may connect center body top edge 16 to center body bottom edge 18.

First wing 12 includes a first wing proximal end 28 that connects to center body 10 at first center body side edge 24. Likewise, second wing 14 includes a second wing proximal end 30 that connects to center body 10 at second center body side edge 26. First wing 12 extends radially outward from center body 10, while second wing 14 extends radially outward from center body 10 in an opposite direction and co-planarly with first wing 12. First wing 12 includes first wing top edge 32, which may be in line with center body top edge 16. Likewise, second wing 12 includes second wing top edge 34, which may be in line with body center body top edge 16 and first wing top edge 32. In this way, the entire stabilizer may present a top edge that is uninterrupted and of even height when deployed. First wing distal end 36 and second wing distal end 38 are positioned at radially opposite ends of the stabilizer, although as noted above, alternative geometric configurations are possible.

First wing 12 and second wing 14 are also characterized by first wing lower edge 40 and second wing lower edge 42, respectively. First wing lower edge 40 and second wing lower edge 42 may be characterized by teeth or serrations, as shown in FIGS. 1, 2, 5, 6, 9, and 10. The purpose of this feature is to ease the insertion of the stabilizer into the ground at the site where a pole 100 is situated in ground 102, as shown in FIGS. 9 and 10. In the illustrated embodiment, these serrations are teeth with points that meet at right angles, as this is a relatively simple shape to cut when forming the stabilizer. But many other variations are possible within the scope of the invention. In another alteration, the serrations at first wing lower edge 40 and second wing lower edge 42 might be omitted in order to simplify construction, possibly at the cost of making insertion of the stabilizer into the ground more difficult, depending upon the nature of the soil.

A feature of the illustrated embodiment is that first wing distal end 36 and second wing distal end 38 extend radially far enough from center body 10 that the serrations at the outer part of first wing lower edge 40 and second wing lower edge 42 reach into a portion of ground 102 that was not disturbed when setting the pole 100. As shown in FIGS. 9 and 10, the entire stabilizer is, in certain uses of the illustrated embodiment, inserted into the ground. This may be performed by, for example, driving the stabilizer into ground 102 with a sledgehammer or with various alternative automated equipment. Typically, when a pole is set, the hole is only dug in a diameter that is slightly larger than the diameter of pole 100 itself. There is no need to dig the hole much larger than this, and thus limiting the diameter of the hole saves time and costs associated with setting the pole. By having first wing distal end 36 and second wing distal end 38 reach further out from pole 100 than the disturbed ground from digging the hole, the stabilizer is able to engage with the firmer, undisturbed ground circumscribing the hole. IN this way, the stabilizer is able to provide a firmer support for pole 100 in ground 102.

Figure 5:
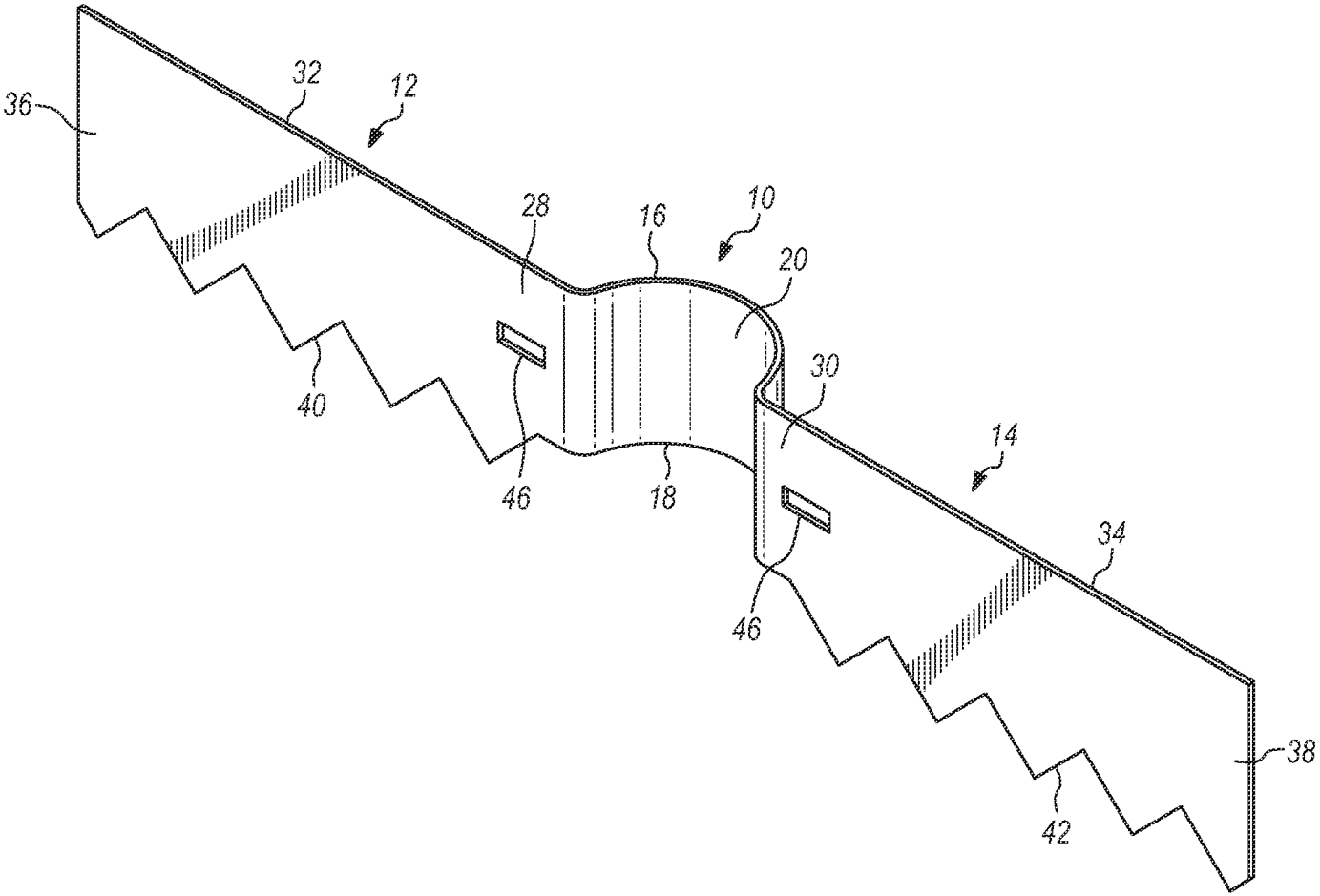
FIG. 5 is a perspective view of an embodiment of the present invention without a bracket.
Figure 6:
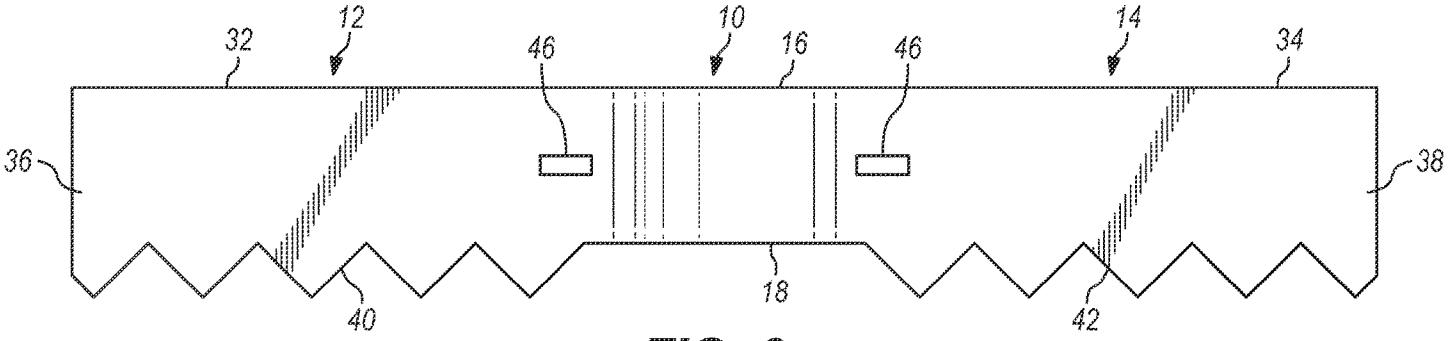
FIG. 6 is a front elevational view of an embodiment of the present invention without a bracket.
Figure 7:
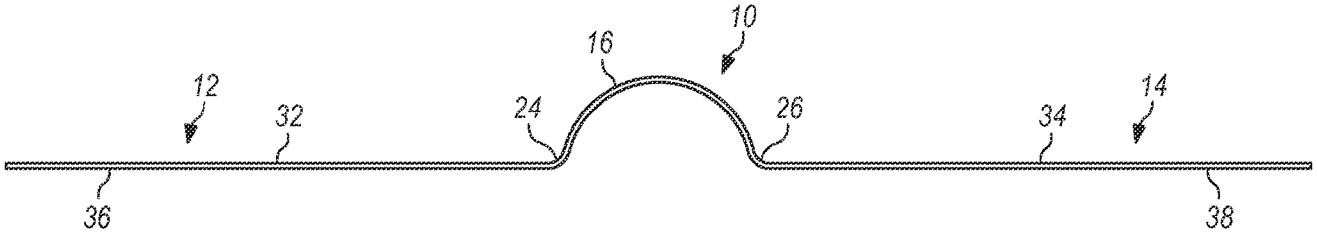
FIG. 7 is a top plan view of an embodiment of the present invention without a bracket.
Figure 8:
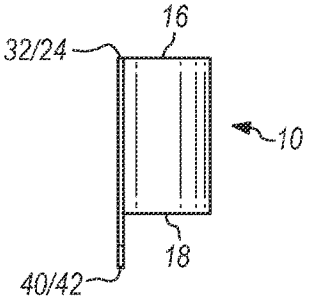
FIG. 8 is an end elevational view of an embodiment of the present invention without a bracket.

Two embodiments of the stabilizer are shown in the illustrations, one with a bracket 44 and one without. The bracket 44 embodiment is shown in FIGS. 1-4 and 9. Bracket 44 is designed to engage with first wing 12 and second wing 14 in order to entirely circumscribe pole 100 with the stabilizer. First wing 12 and second wing 14 may feature wing slots 46 as shown in FIGS. 5 and 6. These wing slots 46 may be aligned with bracket slots 48, as shown in 1 and 2, in order to provide a means of connecting first wing 12 and second wing 14 with bracket 44. (It may be noted that the wing slots 46 are not used in the embodiment of the stabilizer that does not use bracket 44, but may still be present for ease of manufacture and inventory maintenance, since in that way bracket 44 may be adapted to any stabilizer.) To connect first wing 12 and second wing 14 to bracket 44, a bolt 50 is slipped through each corresponding wing slot 46 and bracket slot 48. Each bolt 50 is secured by a nut 52 and a washer 54.

It is envisioned that bracket 44 may be best suited for the fitting of the stabilizer to previously set poles 100 that have begun to lean. The process is to first straighten the pole within its hole in ground 102, then set center body 10 into position against pole 100, attach bracket 44 around pole 100 with bolts 50, then slide the stabilizer downward and drive it into the ground so that pole 100 is secured in a straight, upright position. When the stabilizer is used in connection with the setting of a new pole, stabilizer 44 may not be required; however, it should be understood that stabilizer 44 could be used or not used in connection with either a new pole 100 being set or an existing but leaning pole 100 retrofit, as desired given the application conditions.

An engineering analysis has been performed with respect to proposed use of the stabilizer 44 as described herein. Resistance to single pole deflection is dependent upon soil parameters, such as cohesion, angle of internal friction, and unit weight (whether submerged, saturated, or dry). These soil parameters are site specific and are impacted by weather factors, flooding, disturbance from pole installation procedures, and properties of backfill soils. Notwithstanding the variable nature of in situ and remolded soils at a pole site, a pole stabilizer of the form of stabilizer 44 was found to effectively mobilize resistance of soils outside the pole installation zone. Without stabilizer 44, the pole resistance to deflection is largely dependent on properties of the disturbed soil backfill zone. The configuration and properties of the disturbed soil zone are controlled by installation methods and backfill materials selection.

By mobilizing undisturbed soil, a pole stabilizer such as stabilizer 44 was found to reduce the directional deflection potential of a pole. Stabilizer 44 was found to be especially effective in cohesive soil types including fat and lean clays, sandy clays, and clay-sand-gravel blends. Although the enhanced resistance was found to be soil and site specific, analysis of a range of soil properties indicate that for a pole stabilizer such as stabilizer 44, an increase in directional resistance to lateral forces of two hundred to five hundred percent may be obtained in cohesive soils. In certain applications, multiple stabilizers 44 were found to create an improved resistance in multiple directions.

Resistance increase in non-cohesive soils was determined to be sensitive to the embedment depth of a stabilizer such as stabilizer 44. Review of a range of non-cohesive soil properties indicated that stabilizer 44 could improve directional resistance potential by seventy-five to one hundred and fifty percent. Resistance potential can be increased by greater embedment depth in various applications.

Unless otherwise stated, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein. It will be apparent to those skilled in the art that many more modifications are possible without departing from the inventive concepts herein.

All terms used herein should be interpreted in the broadest possible manner consistent with the context. When a grouping is used herein, all individual members of the group and all combinations and subcombinations possible of the group are intended to be individually included. When a range is stated herein, the range is intended to include all subranges and individual points within the range. All references cited herein are hereby incorporated by reference to the extent that there is no inconsistency with the disclosure of this specification.

The present invention has been described with reference to certain preferred and alternative embodiments that are intended to be exemplary only and not limiting to the full scope of the present invention, as set forth in the appended claims.

The invention claimed is:

1. A pole stabilizer system, comprising:

a ground area, wherein the ground area comprises a disturbed ground area comprising ground disturbed by digging of a hole to place a pole within the hole, and an undisturbed ground area comprising ground undisturbed by the digging of the hole, wherein the undisturbed ground area circumscribes the disturbed ground area;

a center body, wherein the center body comprises a center body top edge and a center body bottom edge, further wherein the center body comprises a center body thickness that is constant from the center body top edge to the center body bottom edge, further wherein a distance from the center body top edge to the center body bottom edge is greater than the center body thickness, further wherein the center body comprises a center body inner face extending between the center body top edge and the center body bottom edge, further wherein the center body comprises an outer face extending between the center body top edge and the center body bottom edge, wherein the center body inner face extends partially circumferentially around a longitudinal axis of the pole, and wherein the outer face extends partially circumferentially around the longitudinal axis of the pole at a greater distance from the longitudinal axis of the pole than the inner face, wherein a distance from the inner face of the center body to the longitudinal axis of the pole is equal to a radius of the pole from the longitudinal axis of the pole to a periphery of the pole, further wherein the center body comprises a first center body side edge connecting the center body top edge and center body bottom edge at a first end of the center body and a second center body side edge connecting the center body top edge and center body bottom edge at a second end of the center body, wherein the first center body side edge is parallel to the second center body side edge;

a substantially planar first wing, wherein the first wing comprises a first wing proximal end connected to the center body first side edge, further wherein the first wing comprises a first wing top edge and a first wing bottom edge, further wherein the first wing comprises a first wing thickness that is constant from the first wing top edge to the first wing bottom edge, further wherein a distance from the first wing top edge to the first wing bottom edge is greater than the first wing thickness, further wherein the first wing bottom edge is adapted to be driven into the ground area, further wherein the first wing comprises a free hanging first wing distal edge connected to the first wing top edge and the first wing bottom edge, wherein the first wing distal edge is sufficiently far from the pole that the first wing distal edge extends into the undisturbed ground area circumscribing the disturbed ground area;

a substantially planar second wing, wherein the second wing comprises a second wing proximal end connected to the center body second side edge, further wherein the second wing comprises a second wing top edge and a second wing bottom edge, further wherein the second wing comprises a second wing thickness that is constant from the second wing top edge to the second wing bottom edge, further wherein a distance from the second wing top edge to the second wing bottom edge is greater than the second wing thickness, further wherein the second wing bottom edge is adapted to be driven into the ground area, further wherein the second wing is parallel to the first wing, further wherein the second wing further comprises a free hanging second wing distal edge connected to the second wing top edge and the second wing bottom edge, wherein the second wing distal edge is sufficiently far from the pole that the second wing distal edge extends into the undisturbed ground area circumscribing the disturbed ground area; and wherein at least a portion of the first wing bottom edge and the second wing bottom edge comprises a plurality of serrations, wherein each of the plurality of serrations comprises a first serration side and a second serration side, wherein the first serration side and the second serration side meet at a serration point pointing downward and perpendicularly to the first wing bottom edge and the second wing bottom edge, wherein a first serration side angle is formed between the first serration side and both the first wing bottom edge and the second wing bottom edge, wherein a second serration side angle is formed between the second serration side and both the first wing bottom edge and the second wing bottom edge, and wherein the first serration side angle and the second serration side angle are complementary.

2. The pole stabilizer of claim 1, further comprising a bracket, wherein the bracket extends from the first wing to the second wing, wherein the bracket is positioned on an opposite side of the longitudinal axis of the pole from the center body, wherein the center body and bracket collectively form a closure around the pole.

3. The pole stabilizer of claim 2, wherein the bracket is attached to the first wing at an area adjacent to the proximal edge of the first wing, and further wherein the bracket is attached to the second wing at an area adjacent to the proximal edge of the second wing.

4. The pole stabilizer of claim 2, wherein the bracket is removably attached to the first wing, removably attached to the second wing, or removably attached to both the first wing and second wing.

5. The pole stabilizer of claim 4, further comprising at least one fastener to removably attach the bracket to the first wing or the second wing.

6. The pole stabilizer of claim 5, further comprising a first fastener and a second fastener, wherein the first fastener removably attaches the bracket to the first wing, and the second fastener removably attaches the bracket to the second wing.

7. The pole stabilizer of claim 1, wherein the center body, first wing, and second wing comprise a single plate.

8. The pole stabilizer of claim 7, wherein the single plate comprises a bent shape at the center body.

9. The pole stabilizer of claim 8, wherein the single plate comprises a steel plate.

10. The pole stabilizer of claim 9, further comprising a moisture-resistant coating on the steel plate.

11. The pole stabilizer of claim 1, wherein the first wing and the second wing are co-planar.

12. The pole stabilizer of claim 1, wherein the distance from the first wing top edge and first wing bottom edge is at least six inches, and further wherein the distance from the second wing top edge to the first wing bottom edge is at least six inches.

13. The pole stabilizer of claim 1, wherein the distance from the center body top edge to the center body bottom edge is at least six inches.

14. The pole stabilizer of claim 1, wherein the first wing distal edge is at least eighteen inches from the longitudinal axis of the pole and extending into the undisturbed ground area, and wherein the second wing distal edge is at least eighteen inches from the longitudinal axis of the pole and extending into the undisturbed ground area.

15. The pole fastener of claim 1, wherein the center body inner face is shaped to mate with a side of the pole.

16. The pole fastener of claim 1, wherein the first serration side and the second serration side form a right angle at the serration point.

17. A method for stabilizing a pole mounted in a hole in a ground area, the method comprising the steps of:

straightening the pole in the ground area, wherein the ground area comprises a disturbed ground area comprising ground disturbed by digging of the hole to place the pole, and an undisturbed ground area comprising ground undisturbed by the digging of the hole, wherein the undisturbed ground area circumscribes the disturbed ground area;

setting a center body of a stabilizer into position against the pole, wherein the center body comprises a center body top edge and a center body bottom edge, further wherein the center body comprises a center body thickness that is constant from the center body top edge to the center body bottom edge, further wherein a distance from the center body top edge to the center body bottom edge is greater than the center body thickness, further wherein the center body comprises a center body inner face extending between the center body top edge and the center body bottom edge, further wherein the center body comprises an outer face extending between the center body top edge and the center body bottom edge, wherein the center body inner face extends partially circumferentially around a longitudinal axis of the pole when the center body is positioned against the pole, and wherein the outer face extends partially circumferentially around the longitudinal axis of the pole at a greater distance from the longitudinal axis of the pole than the inner face, wherein a distance from the inner face of the center body to the longitudinal axis of the pole is equal to a radius of the pole from the longitudinal axis of the pole to a periphery of the pole, further wherein the center body comprises a first center body side edge connecting the center body top edge and center body bottom edge at a first end of the center body and a second center body side edge connecting the center body top edge and center body bottom edge at a second end of the center body, wherein the first center body side edge is parallel to the second center body side edge;

attaching a bracket around the pole with a plurality of bolts to the center body of the stabilizer, wherein the bracket extends from the first wing to the second wing, wherein the bracket is positioned on an opposite side of the longitudinal axis of the pole from the center body, wherein the center body and bracket collectively form a closure around the pole; and sliding the stabilizer downward and driving it into the ground area, wherein the stabilizer further comprises a substantially planar first wing, wherein the first wing comprises a first wing proximal end connected to the center body first side edge, further wherein the first wing comprises a first wing top edge and a first wing bottom edge, further wherein the first wing comprises a first wing thickness that is constant from the first wing top edge to the first wing bottom edge, further wherein a distance from the first wing top edge to the first wing bottom edge is greater than the first wing thickness, further wherein the first wing bottom edge is adapted to be driven into the ground area, further wherein the first wing comprises a free hanging first wing distal edge connected to the first wing top edge and the first wing bottom edge, wherein the first wing distal edge is sufficiently far from the pole that the first wing distal edge extends into the undisturbed ground area, and further wherein the stabilizer comprises a substantially planar second wing, wherein the second wing comprises a second wing proximal end connected to the center body second side edge, further wherein the second wing comprises a second wing top edge and a second wing bottom edge, further wherein the second wing comprises a second wing thickness that is constant from the second wing top edge to the second wing bottom edge, further wherein a distance from the second wing top edge to the second wing bottom edge is greater than the second wing thickness, further wherein the second wing bottom edge is adapted to be driven into the ground area, further wherein the second wing is parallel to the first wing, further wherein the second wing further comprises a free hanging second wing distal edge connected to the second wing top edge and the second wing bottom edge, wherein the second wing distal edge is sufficiently far from the pole that the second wing distal edge extends into the undisturbed ground area circumscribing the disturbed ground area; and wherein at least a portion of the first wing bottom edge and the second wing bottom edge comprises a plurality of serrations, wherein each of the plurality of serrations comprises a first serration side and a second serration side, wherein the first serration side and the second serration side meet at a serration point pointing downward and perpendicularly to the first wing bottom edge and the second wing bottom edge, wherein a first serration side angle is formed between the first serration side and both the first wing bottom edge and the second wing bottom edge, wherein a second serration side angle is formed between the second serration side and both the first wing bottom edge and the second wing bottom edge, and wherein the first serration side angle and the second serration side angle are complementary.

18. The method of claim 17, wherein the step of attaching the bracket comprises the step of attaching the bracket to the first wing at an area adjacent to the proximal edge of the first wing, and attaching the bracket to the second wing at an area adjacent to the proximal edge of the second wing.

* * * * *